US011111778B2

(12) United States Patent
Santarelli

(10) Patent No.: US 11,111,778 B2
(45) Date of Patent: Sep. 7, 2021

(54) INJECTION WELLS

(71) Applicant: Geomec Engineering Limited, London (GB)

(72) Inventor: Frederic Joseph Santarelli, Stavanger (NO)

(73) Assignee: GEOMEC ENGINEERING LTD., London (GB)

( * ) Notice: Subject to any disclaimer, the term of this patent is extended or adjusted under 35 U.S.C. 154(b) by 31 days.

(21) Appl. No.: 16/612,390

(22) PCT Filed: May 23, 2018

(86) PCT No.: PCT/GB2018/051395
§ 371 (c)(1),
(2) Date: Nov. 10, 2019

(87) PCT Pub. No.: WO2018/215764
PCT Pub. Date: Nov. 29, 2018

(65) Prior Publication Data

US 2020/0199998 A1 Jun. 25, 2020

(30) Foreign Application Priority Data

May 24, 2017 (GB) ..... 1708293

(51) Int. Cl.
*E21B 43/26* (2006.01)
*E21B 47/06* (2012.01)
(Continued)

(52) U.S. Cl.
CPC ..... *E21B 47/07* (2020.05); *E21B 43/26* (2013.01); *E21B 41/0092* (2013.01);
(Continued)

(58) Field of Classification Search
CPC ..... E21B 43/26; E21B 43/16; E21B 47/06
See application file for complete search history.

(56) References Cited

U.S. PATENT DOCUMENTS 4,523,459 A * 6/1985 Hastings ..... E21B 47/10 166/271
7,536,905 B2 * 5/2009 Jalali ..... E21B 47/103 73/152.33

(Continued)

FOREIGN PATENT DOCUMENTS

WO WO 2015/126388 A1 8/2015
WO WO 2016/099470 A1 6/2016

OTHER PUBLICATIONS

European Patent Office as International Searching Authority; International Search Report and Written Opinion for PCT/GB2018/051395; dated Oct. 29, 2018; all pages European Patent Office; Rijswijk, The Netherlands.

(Continued)

*Primary Examiner* — Kenneth L Thompson
(74) *Attorney, Agent, or Firm* — Law Office of Jesse D. Lambert, LLC

(57) ABSTRACT

A method for providing a well injection program in which injection testing is performed on an existing well which is intended to be an injection well in a field development. Water is injected into the well in a series of step rate tests or injection cycles, the data is modelled to determine thermal stress characteristics of the well and by reservoir modelling the optimum injection parameters are determined for the well injection program to provide for maximum recovery. The thermal stress characteristics are those that would previously have been obtained from core samples when the well was drilled. Further wells on a development can be tested and the individual thermal stress characteristics of each well combined in the reservoir model for optimized field development.

20 Claims, 4 Drawing Sheets

(51) Int. Cl.

| | |
|---|---|
| ***E21B 47/07*** | (2012.01) |
| *E21B 41/00* | (2006.01) |
| *E21B 43/20* | (2006.01) |
| *E21B 49/00* | (2006.01) |

(52) U.S. Cl.
CPC ..... *E21B 43/20* (2013.01); *E21B 49/006* (2013.01); *E21B 49/008* (2013.01)

(56) References Cited

U.S. PATENT DOCUMENTS

| | | | | |
|---|---|---|---|---|
| 7,778,780 | B2 * | 8/2010 | Kimminau | E21B 47/103 702/12 |
| 8,204,727 | B2 * | 6/2012 | Dean | G01V 99/00 703/10 |
| 10,606,967 | B2 * | 3/2020 | Yateem | E21B 41/0092 |
| 10,664,633 | B2 * | 5/2020 | Kang | E21B 43/16 |
| 10,718,206 | B2 * | 7/2020 | Weng | G01K 11/32 |
| 10,846,443 | B2 * | 11/2020 | Petukhov | G06F 17/10 |
| 2010/0004906 | A1 | 1/2010 | Searles et al. | |
| 2013/0132050 | A1 | 5/2013 | Parry et al. | |
| 2013/0246022 | A1 | 9/2013 | Frydman et al. | |
| 2014/0169131 | A1 | 6/2014 | Sinha | |
| 2016/0003026 | A1 * | 1/2016 | Adams | E21B 47/06 166/250.01 |
| 2016/0245049 | A1 * | 8/2016 | Mogensen | E21B 43/28 |
| 2018/0094514 | A1 * | 4/2018 | Leem | E21B 43/26 |
| 2020/0072027 | A1 * | 3/2020 | Santarelli | E21B 47/06 |
| 2020/0190968 | A1 * | 6/2020 | Lolla | E21B 44/10 |

OTHER PUBLICATIONS

Intellectual Property Office of the United Kingdom Patent Office; search report for GB1708293.4; dated Oct. 3, 2017; all pages; Intellectual Property Office; Newport, UK.

Perkins, T.K. et al; Changes in Earth Stresses Around a Wellbore Caused by Radially Symmetrical Pressure and Temperature Gradients; Society of Petroleum Engineers Journal; Apr. 1984; pp. 129-140; Society of Petroleum Engineers; US.

Perkins, T.K. et al; The Effect of Thermoelectric Stresses on Injection Well Fracturing; Society of Petroleum Engineers Journal; Feb. 1985; pp. 77-88; Society of Petroleum Engineers; US.

* cited by examiner

| WELL | THICKNESS (m) | POROSITY (%) | RESERVOIR PRESSURE (psi) | STRESS PATH (psi/psi) | THERMAL STRESS PARAMETER (psi/°C) | MINIMUM STRESS (psi) |
|---|---|---|---|---|---|---|
| 1 | 30.78 | 22.1 | 4764 | 0.8 | 27.5 | 7200 |
| 2 | 34.44 | 24 | 4966 | 0.8 | 15 | 6750 |
| 3 | 16.15 | 22.6 | 4826 | 0.8 | 27.5 | 7500 |
| 4 | 36.42 | 23.4 | 4571 | 0.8 | 17 | 6650 |

Fig. 7

INJECTION WELLS

The present invention relates to injecting fluids into wells and more particularly, to a method for injection testing in existing wells to evaluate thermal stress effect characteristics for reservoir modelling and so better determine injection parameters for the well as an injection well for the overall field development.

Current hydrocarbon production is primarily focused on maximising the recovery factor from a well. This is because we have already exploited all the areas which might contain oil leaving only those that are in remote and environmentally sensitive areas of the world (e.g. the Arctic and the Antarctic). While there are huge volumes of unconventional hydrocarbons, such as the very viscous oils, oil shales, shale gas and gas hydrates, many of the technologies for exploiting these resources are either very energy intensive (e.g. steam injection into heavy oil), or politically/environmentally sensitive (e.g. 'fracking' to recover shale gas).

To improve the recovery factor in a well it is now common to inject fluids, typically water, into the reservoir through injection wells. This form of improved oil recovery uses injected water to increase depleted pressure within the reservoir and also move the oil in place so that it may be recovered. If produced water is re-injected this also provides environmental benefits.

Reservoir models are used in the industry to analyze, optimize, and forecast production. Such models are used to investigate injection scenarios for maximum recovery and provide the injection parameters for an injection program. Such an injection program may drill new appraisal wells to act as injectors or convert existing production wells into injection wells. Geological, geophysical, petrophysical, well log, core, and fluid data are typically used to construct the reservoir models. Much of this data is only available when the well is drilled and thus the models rely on using historical data and assumptions that the physical properties of the formation will not change in time. Indeed, the properties of the rock in the formation are traditionally obtained by taking measurements on core samples only available when the well is drilled.

A known disadvantage in this approach is in the limitation of the models used and their reliance on the data provided by the core samples. While many techniques exist to contain and transport the core samples so that they represent well conditions in the laboratory, many measurements cannot scale from the laboratory to the well and there is a lack of adequate up-scaling methodologies. Additionally for an existing injection well, or for a producing well being changed to an injection well, any error in the value assigned to the physical properties will likely have been perpetuated through the models and, where there may be multiple injectors on a field, the forecasts based on these combined events may be remote from the true values.

Additionally, on injecting a cool fluid into warm subterranean reservoir, a cooling effect will occur around the injector. This alters the stresses in the region with altered temperature. A consequence is that the fracture pressure around an injector will vary with time. The amount of variation will be dependent on the thermal stress characteristics of the formation. While these can theoretically be measured on a core sample in the laboratory such a measurement which is dependent on a pressure/temperature relationship can't be adequately scaled and they are found to be multiple factors out when attempts are made to scale to well dimensions.

U.S. Pat. No. 8,116,980 to ENI S.p.A. describes a testing process for testing zero emission hydrocarbon wells in order to obtain general information on a reservoir, comprising the following steps: injecting into the reservoir a suitable liquid or gaseous fluid, compatible with the hydrocarbons of the reservoir and with the formation rock, at a constant flow-rate or with constant flow rate steps, and substantially measuring, in continuous, the flow-rate and injection pressure at the well bottom; closing the well and measuring the pressure, during the fall-off period (pressure fall-off) and possibly the temperature; interpreting the fall-off data measured in order to evaluate the average static pressure of the fluids (Pay) and the reservoir properties: actual permeability (k), transmissivity (kh), areal heterogeneity or permeability barriers and real Skin factor (S); calculating the well productivity. Such injection testing at an existing well has advantages over conventional production testing in removing the requirement to dispose of produced hydrocarbons with its incumbent safety and environmental issues. However, such testing has so far been limited to the determination of fluid properties, in particular the permeability, and formation damage in measuring the skin factor, to determine well productivity.

It is therefore an object of the present invention to provide a method for a well injection program in which injection testing is used to determine thermal stress characteristics of the existing well.

It is a further object of the present invention to provide a method for a well injection program in which injection testing is used to determine more accurate values for parameters used in well interpretation.

According to a first aspect of the present invention there is provided a method for a well injection program, comprising the steps:

(a) injecting a fluid into a well;
(b) varying the flow rate of the injected fluid;
(c) measuring the pressure, temperature and flow rate at the well as the flow rate is varied to provide measured data;
(d) fitting a first model to the measured data to estimate one or more thermal stress characteristics of the well;
(e) inputting the one or more thermal stress characteristics into a second model; and
(f) determining injection parameters from the second model for the well.

In this way, by accurately determining the thermal stress characteristics during well start-up, injection parameters can be determined for injection confinement with the greatest injection efficiency.

Additionally, by determining the thermal stress characteristics at the well, more accurate calibration data is used in the second model than are available from measurements on the original core samples.

Preferably, the flow rate is varied to provide a series of injection cycles with each injection period being followed by a shut-in. In this way, fracturing can occur on the first cycle and increased zone cooling on further cycles. These may be considered as step rate tests. Preferably, fracture pressure is measured on a pressure sensor. More preferably, the flow rate is stepped-up at each injection period. Preferably, the flow rate is stepped-down at the end of each injection period. More preferably, bean-up and choke back are used to determine a fracture pressure (Pfrac) value with there being two values for each injection cycle. The shut-in may be hard and a fracture closure pressure (Pclos) determined.

Preferably, the duration of the injection period varies between injection cycles. Preferably, the shut-in time is fixed.

Preferably, the first model describes the development of the thermal stresses around the well on the measured data to estimate the one or more thermal stress characteristics. Preferably the one or more thermal stress characteristics includes a thermal stress parameter (AT). Preferably the one or more thermal stress characteristics includes an in-situ stress (σ). More preferably the one or more thermal stress characteristics includes the minimum in situ stress (σmin).

Preferably the second model is a reservoir model or a hydraulic fracture model. Such models are known in the art for well planning and optimization. In this way, the present invention can utilize models and techniques already used in industry.

Preferably, pressure, temperature and flow rate are measured at the surface of the well. In this way, the injection parameters based on these values can be better determined.

Preferably, a pressure sensor, a temperature sensor and a flow rate meter are located at the wellhead. More preferably, one or more downhole sensors are present. The downhole sensors may be pressure and/or temperature sensors. Preferably, the sensors data sampling rate is less than 1 Hz. More preferably, the sensors data sampling rate is between 0.2 Hz and 1 Hz.

Preferably the downhole sensors transmit data to the surface in real-time. Alternatively, the downhole sensors include memory gauges on which the measured data is stored.

Preferably the method includes the step of measuring pressure for different temperatures of injected fluid. In this way, better characterisation of the effects of the cooling effect can be determined.

Preferably, the method includes the step of measuring the pressure and flow rate during the first injection cycle and shut in/step rate test and determining fracturing has occurred. In this way, remedial steps can be taken to ensure fracturing occurs in the second injection cycle and shut in. Preferably, parameters for the second injection cycle are determined from the first injection cycle. In this way, rate ramping schedule and duration of high rate injection can be optimized. Preferably, these steps are repeated for further injection cycles/step rate tests.

Preferably, the injected fluid is water. In this way, the injected water will be whatever is available at the injector well. The injected fluid may be treated such as with a bactericide or scale inhibitor. The injected fluid may further include a viscosifier. The method may include the step of introducing a viscosifier to the fluid during injection. In this way, the viscosifier can be added if fracturing is not achieved on a first injection cycle.

Preferably the well injection parameters are selected from a group comprising: injection fluid temperature, fluid pump rate, fluid pump duration and fluid injection volume.

Preferably, the method includes the further step of carrying out well injection using the well injection parameters.

Preferably, the method is repeated for one or more wells and the second model combines the data from all the wells to determine individual well injection parameters. In this way, the overall injected volume on a field can be maintained to ensure perfect mass balance.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined or even horizontal.

Embodiments of the present invention will now be described, by way of example only, with reference to the accompanying Figures, of which:

FIG. 7 is an analysis of the fracture pressure history on four water injectors.

Figure 1:
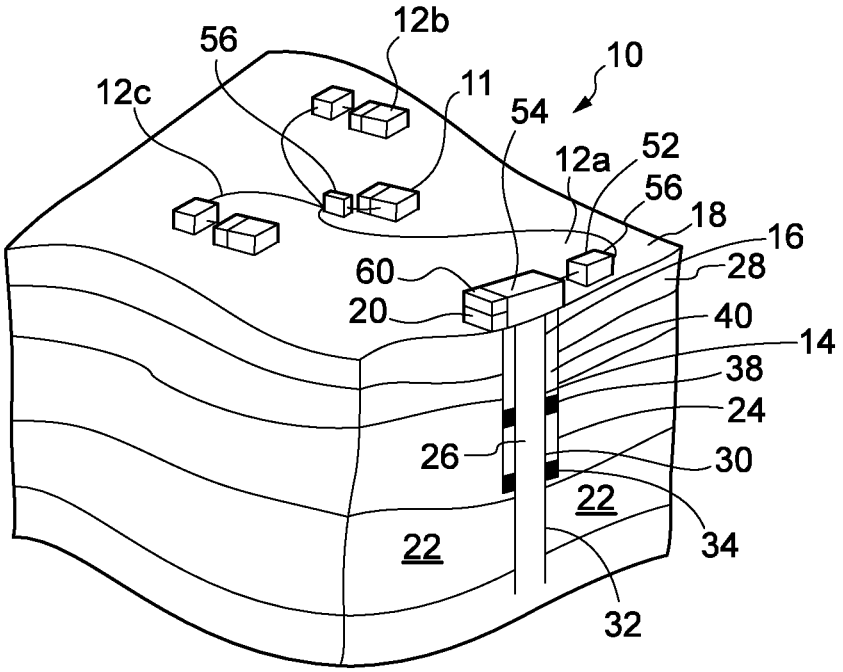
FIG. 1 is a schematic illustration of a field development including a production well and injection wells on which injection well tests are performed according to an embodiment of the present invention.

Reference is initially made to FIG. 1 of the drawings which illustrates an oilfield development for produced water re-injection, generally indicated by reference numeral 10, having a production well 11 and four injector wells 12*a-c* wherein the injector wells are existing wells on which injection testing will be carried out in accordance with an embodiment of the present invention. In FIG. 1, the well 12*a* is shown as entirely vertical with a single formation interval 22, but it will be realised that the well 12*a* could be effectively horizontal in practise. Dimensions are also greatly altered to highlight the significant areas of interest. Well 12*a* is drilled in the traditional manner providing a casing 24 to support the borehole 26 through the length of the cap rock 28 to the location of the formation 22. Formation 22 is a conventional oil reservoir. Standard techniques known to those skilled in the art will have been used to identify the location of the formation 22 and to determine properties of the well 12*a* when the well 12*a* was drilled.

Production tubing 30 is located through the casing 24 and tubing 32, in the form of a production liner, is hung from a liner hanger 34 at the base of the production tubing 30 and extends into the borehole 26 through the formation 22. A production packer 38 provides a seal between the production tubing 30 and the casing 24, preventing the passage of fluids through the annulus there-between. The casing 24 and production liner 32 may be cemented in place. Perforations will have been formed in the production liner 32 to access the formation. All of this would have been performed as the standard technique for drilling and completing the well 12*a* in a formation 22. Well 12*a* may have been a production well. Were well 12*a* was completed as an injector well, the production liner 32 may be a slotted liner instead. Other completions may also be present such as an open-hole screen with packers for example. These completions are all as known in the art.

At surface 18, there is a standard wellhead 54. Wellhead 54 provides a conduit (not shown) for the passage of fluids into the well 12*a*. Wellhead 54 also provides a conduit 58 for the injection of fluids from pumps 56. Wellhead sensors 60 are located on the wellhead 54 and are controlled from the data acquisition unit 20 which also collects the data from the wellhead sensors 60. Wellhead sensors 60 include a temperature sensor, a pressure sensor and a flow rate sensor. The sensors 60 have a sampling frequency of between 0.2 Hz and 1 Hz. Other sampling frequencies may be used but they must be sufficient to measure changes in the pressure during the rate ramp-up and when shut-in occurs. All of these surface components are standard at a wellhead 54.

In this embodiment there is also a downhole pressure sensor 14. Downhole pressure sensors 14 are known in the industry and are run from unit 20 at surface 18, to above the production packer 38. The downhole pressure sensor 14 typically combines a downhole temperature and pressure sensor. The sensor 14 is mounted in a side pocket mandrel in the production tubing 30. Data is transferred via a cable 16 located in the annulus 40. The sensor 14 may be a standard sensor though, for the present invention, the sensor 14 must be able to record downhole pressure data at a data acquisition rate of between 0.2 Hz and 1 Hz which is within the range of current sensors. Alternatively, sensor 14 may be a retrievable memory sensor in which recorded data stored in an on-board memory to be analysed later when the sensors are retrieved. This will only provide historical data compared to the real-time monitoring available from a cabled sensor 14 and the wellhead sensors 60.

At surface 18, the data is transferred to a data acquisition unit 20. The unit 20 can control multiple sensors used on the well 12*a*. The unit 20 can also be used to coordinate when pressure traces are recorded on the sensor 14 to coincide with an injection operation by, for example, having control of pumps 56 or by detecting a change in rate at the wellhead sensors 60. In this way all the sensors 14, 60 will be on the same clock. Unit 20 will include a processor and a memory storage facility. Unit 20 will also have a transmitter and receiver so that control signals can be sent to the unit 20 from a remote control unit and the measured data can be analysed remotely in real-time.

The pumps 56 and water used will be that present at surface. Thus, in the context that the wells 12*a-c* are development wells (injector wells) we are constrained by the existing infrastructure which is fixed. The completion of the wells 12*a-c* is fixed. The surface facilities in terms of the pump system which may be shared between wells and its capacity is also fixed. The water, its composition and quality is also predetermined, though there may be an opportunity for the water to be treated with chemicals, for example bactericide or scale inhibitors. A viscosifier may also be used, but it may only be required to be added if fracturing is not achieved on first injection.

For the data analysis we need to consider how to define the thermal stresses. We consider the work of T. K. Perkins and J. A. Gonzalez: 'Changes in Earth Stresses around a Wellbore Caused by Radially Symmetrical Pressure and Temperature Gradients'. SPE Journal, April, pp 129-140, 1984 and 'The Effect of Thermoelastic Stresses on Injection Well Fracturing'. SPE Journal, February, pp 78-88, 1985, incorporated herein by reference. Both these papers describe the changes of temperature due to injecting fluid at a constant temperature (BHT), the BHT being different from the virgin reservoir temperature (Tres). In turn the stresses are altered in the region with altered temperature. In particular the stress change ($\Delta\sigma$) is quantified by the following equation (tension negative):

$$\Delta\sigma = kAT(BHT - \text{Tres}) \quad (1)$$

k is the shape factor and Perkins and Gonzalez give formulas for a circular and an elliptical disk;

AT is the thermal stress parameter related to the thermoelastic properties of the formation through:

$$AT = aTE/(1-v) \quad (2)$$

aT is the thermal expansion of the formation

E is Young's Modulus of the formation v is Poisson's ratio of the formation

This tells us that the fracture pressure around an injector will vary over time and thus the thermal stress parameter is a key factor to the design of a well injection program and the injection parameters chosen. From the perspective of hydraulic fracture propagation, injection confinement essentially depends on three main parameters:

Water cleanliness, which can be controlled at surface but is likely to worsen due to the circulation in the lines and tubing;

The natural stress contrast between sand and shale at the top reservoir if any exists; and The reduction of the fracture pressure around the injection well due to the cooling effect.

The latter of these will last throughout the life of a reservoir. However, if produced water is re-injected, its magnitude will decrease over time as more produced water is added to the injected mix. This is the case as the produced water will increase the temperature of the injected mix. If we consider injection efficiency over the years which an injection program can run, the percentage of produced water, temperature, damaging solids and oil droplets and fracture pressure all increase over the life of the well with the injectivity-risk of leakage from an injection zone also increasing for the life of the well.

Thus the time varying consequences from the thermal stress parameter mean that it is vital to quantify this parameter prior to undertaking any field development program.

Figure 2:
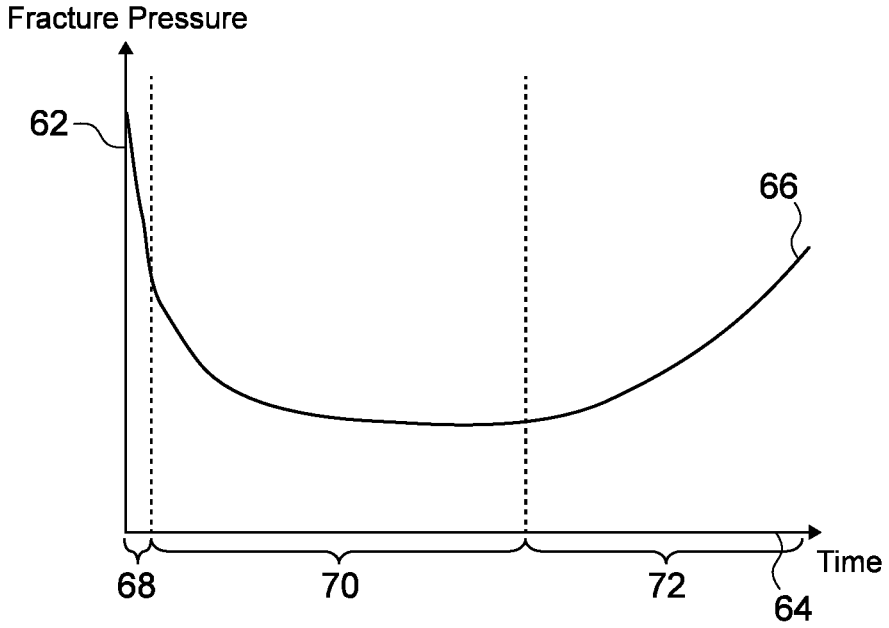
FIG. 2 is a graph of fracture pressure versus time illustrating the variation of fracture pressure for a produced water re-injection well without significant reservoir pressure variation.

Referring to FIG. 2 of the drawings there provided a graph of fracture pressure 62 versus time 64 illustrating the variation of fracture pressure for a produced water re-injection well with a constant reservoir pressure. The graph 66 can be considered to represent three stages. In the first stage 68, one to two days can be used to fracture the well with a "large" BHT using the geothermal gradient to help having large BHT, see equations above. Here there is a sharp decrease in fracture pressure over the small time period. For the second stage 70, cold (sea)water is injected at large rate and progressively increases the cold zone around the well and the shape factor (k) increases. Here a slower decline in fracture pressure is observed over a longer time period i.e. months rather than days. It is this second stage which we utilise in injection testing of the wells in the present invention. The third stage 72 can be considered as the start of a produced water re-injection process.

To determine the thermal stress parameter we undertake injection testing at the well 12*a*. Using the arrangement shown in FIG. 1 we perform repeated fracture pressure measurements during step rate tests and/or fall-off analysis after injection cycles.

Figure 3:
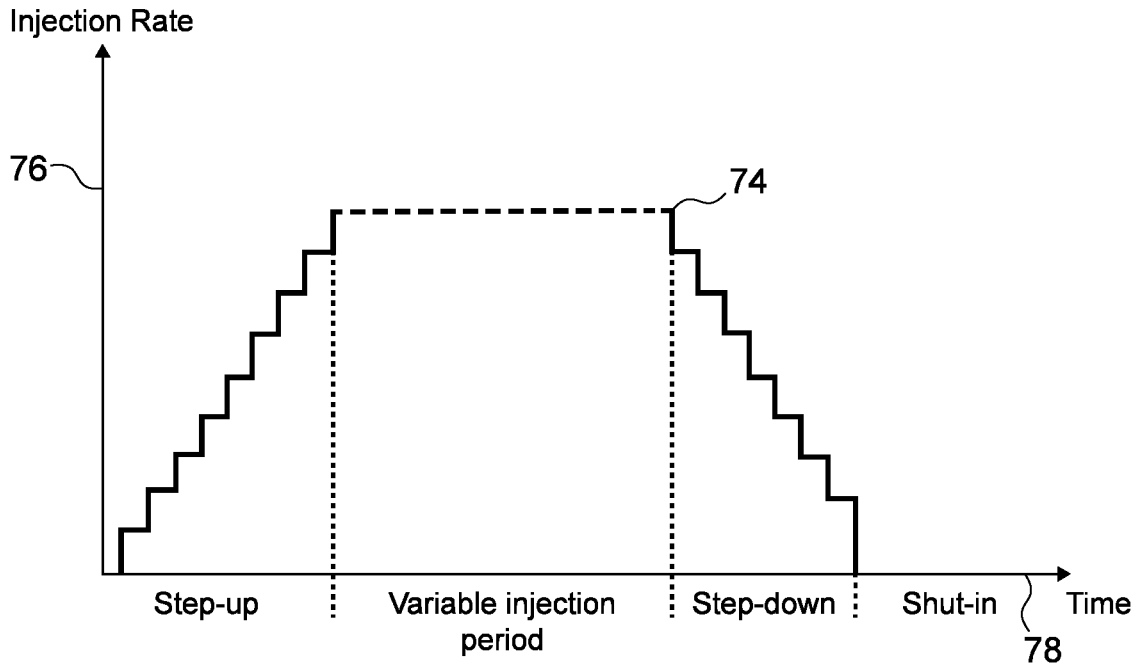
FIG. 3 is a graph of injection rate versus time during an injection test in single injection cycle.

We will now consider an example of an Injection Test Sequence, were series of step rate tests with flow and shut in are performed as shown in FIG. 3. FIG. 3 illustrates a single step rate test or injection cycle which is repeated for varying injection periods with fixed shut-in periods. For each step rate test 74 the water is injected at an injection rate Q 76 into the well 12 for a period of time 78 and then the well 12 is shut-in for a further period of time. Each period of injection gets progressively longer.

For the injection period, the injection is constant and at a high rate 76. Each injection period gets progressively longer, whereas each shut-in period is of a fixed time duration. Thus the shut-in may be 12 hours with a frequency of shut-in started at one per day and then spaced to one per week, to continue increasing to one per month. This pattern increases the zone in the formation affected by the thermal effect during each injection cycle and thus plays on the k term in Equation (1). Using a bean-up and choke-back schedule the injection rate is stepped-up and stepped-down, respectively at the beginning and end of each injection cycle. This provides for the determination of a Pfrac value. Though not preferred, the shut-in can be hard to provide a Pclos value. The shut-in can be analysed as known in the art to by using classic fall-off analyses to determine further parameters such as reservoir pressure, kh product, flow regime etc. Such data can be used as calibration data in the second model.

The test is followed up and analysed in real-time either on site or remotely. The first injection cycle is analysed during its shut-in to ensure that fracturing has occurred and at which pressure/rate. If fracturing has not occurred a switch of pumps can be undertaken or the introduction of a viscosifier to increase the fluid viscosity can be considered. If it has the occurrence of a clear break-down, this must be accounted for. The second cycle may be modified based on the results of the first cycle from which modifications in the form of rate ramping schedule and duration of high rate injection can be modified. The analysis is repeated for each cycle.

Figure 4:
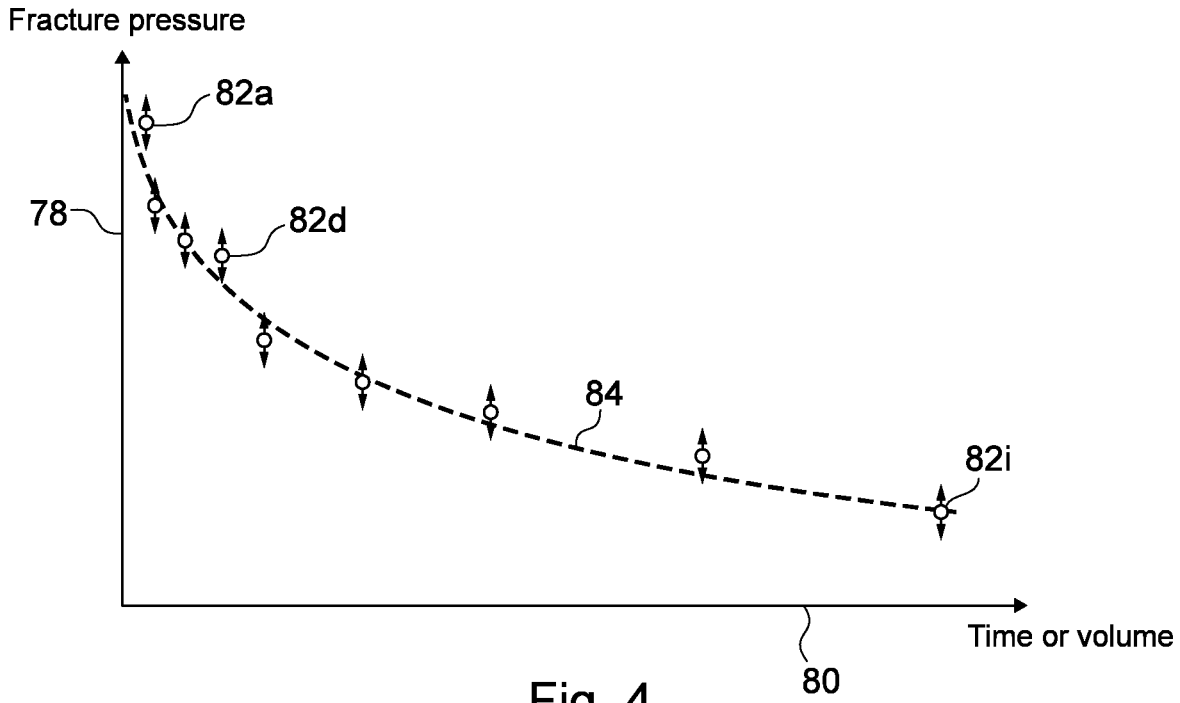
FIG. 4 is a graph of fracture opening pressure and reservoir pressure versus time around an injector is a graph of pressure versus time during an injection test and a first model fit to the measured data.

Referring to FIG. 4, there is illustrated a graph of the change in pressure 78 versus time 80, with the data shown as individual measurement points 82*a-i* across a number of SRTs. We then fit a model 84 describing the development of the thermal stresses around the well on the measured data to estimate the thermal stress parameter (AT) and the minimum in situ stress (σmin). Those skilled in the art will appreciate that the fit can be a manual fit or use linear Lagrangian optimization.

Figure 5:
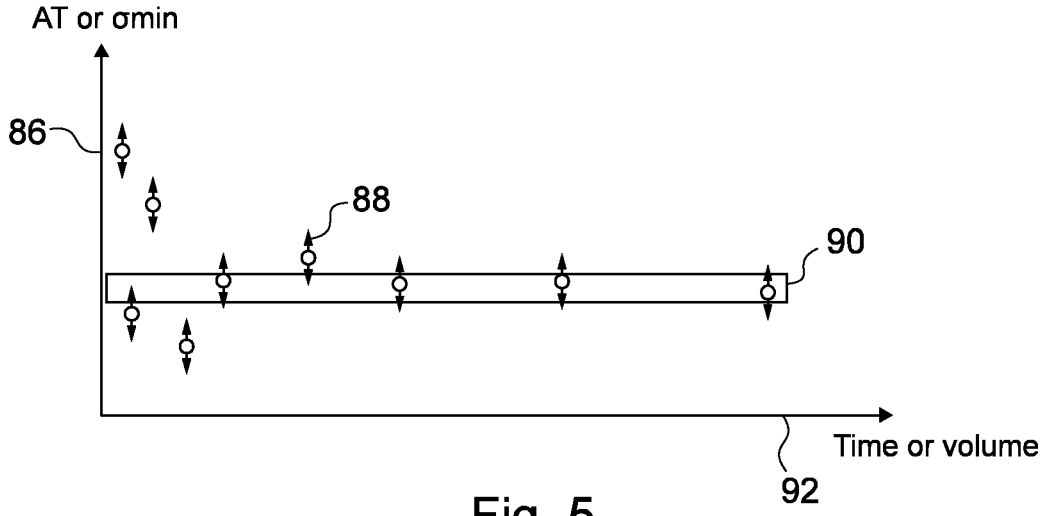
FIG. 5 is a graph of a best fit of the thermal stress characteristics in time.

Each injection cycle provides two values of Pfrac. The model is fitted to these data to extract the best values of the thermal stress parameter (AT) and of the minimum in situ stress (σmin). Each new injection cycle provides two new values of Pfrac. The model is fitted again to the entire data set including these new values to estimate AT and σmin. The process is repeated for each cycle until the best fits for AT and σmin stabilize. This is as illustrated in FIG. 5 showing the values 86 with a best fit 88 after n cycles within a stabilized band-width 90 against time or volume 92. The full analysis of the shut in of each cycle provides a QC/QA of the raw dataset of Pfrac and allows determination of possible sources of bias e.g. variation of the reservoir pressure.

Those skilled in the art will recognize that closed form solutions or numerical models can be used. In either case, the injection history (injection rate Q and bottom hole temperature BHT) is discretised: more precisely the BHT versus injected volume (V) curve is created.

Figure 6:
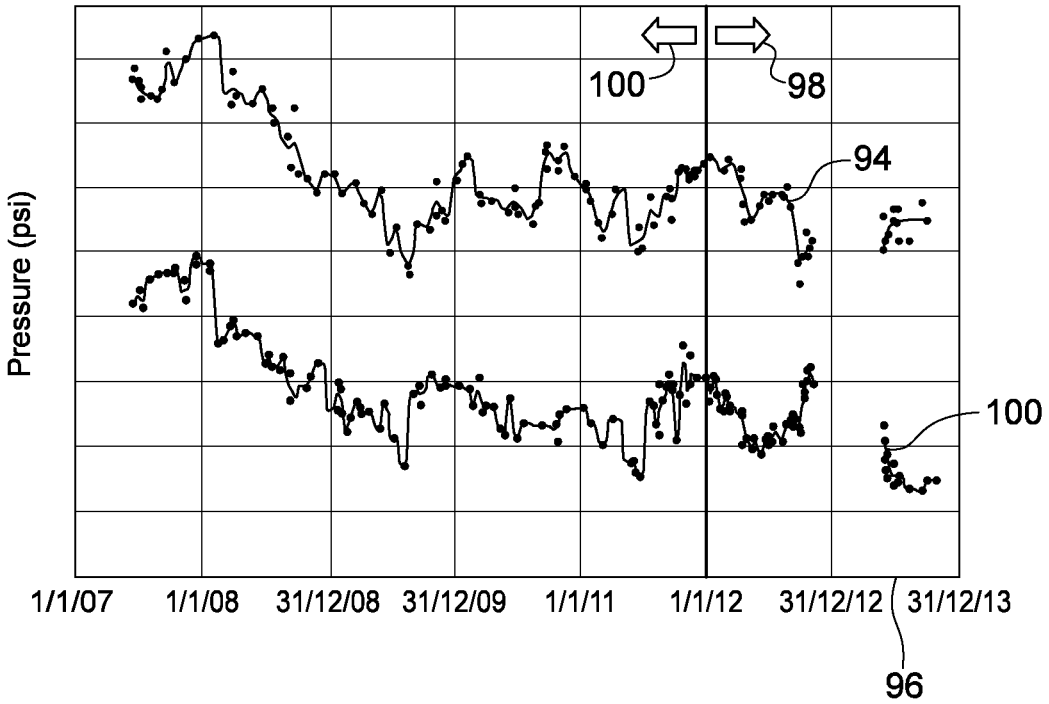
FIG. 6 is a graph of fracture opening pressure and reservoir pressure versus time around an injector.

For the closed form solutions, the temperature distribution in the region affected by heat convection is established; the kernel solutions provided by Perkins and Gonzalez are used in conjunction with the superposition theorem—i.e. linear problem—to compute the stress changes in the region affected by the thermal effects; and the variation over time of the fracture pressure near the well is calculated. FIG. 6 shows an illustration of the measured fracture pressure 94 variation over time 96 around an injector. This is shown both in real-time 98 and by back analysis 100. This illustrates that the reservoir pressure 102, but mainly injection temperature and cold zone development all affect the fracture pressure.

For the numerical models, two solutions are possible to compute the variation of the fracture pressure around the well over time. The "classic" approach consists of using a flow model which accounts for heat convection (usually finite difference based) and then couples it with a mechanical model (usually finite element based). Alternatively a fully coupled model solving simultaneously for flow, heat transfer and mechanics can be used. However, this requires complex numerical techniques not commonly used in the oil industry—e.g. mixed element, mesh refinement, etc.

For either case a hydraulic fracture model can also be considered i.e. either a numerical model or asymptotic solutions (PKN, GdK, etc.).

The best fits for AT and σmin values can be incorporated into a reservoir model or other known models known to those skilled in the art from which the injection parameters can be calculated. Such injection parameters will be injection fluid temperature, fluid pump rate, fluid pump duration and fluid injection volume.

Were a field development 10 has more than one injector well, an injection test is preferably performed on each injector well 12*a-c*.

Best fits for AT and σmin values are determined for each well 12*a-c* and these values provided to a reservoir model which forecasts over the entire development 10. In this way, the injection parameters for the wells 12*a-c* are chosen so that the overall need for produced water re-injection volume can be met while ensuring a perfect mass balance. Other considerations such as whether the wells 12*a-c* are all from a common pump may constrain injection parameters selected.

To see the importance of determining the thermal stress parameter (AT) and minimum stress (σmin) values we refer to FIG. 7. This provides an analysis history on four water injection wells. The four offset wells are in the same reservoir with a few hundred metres of separation between them. The thickness, porosity and reservoir pressure are all measured from the completion and logs on the individual wells. The reservoir pressure value is at pre-production. The stress path has been fixed as a constant 0.8. Using available measurement data, the thermal stress parameter and minimum stress values are calculated for each well. These show an 84% variation in the thermal stress parameter between the wells through formation heterogeneities. There is also a 13% variation in the minimum stress across the wells indicative of a faults impact. Such large variations in the thermal stress parameter (AT) and minimum stress (σmin) values will greatly affect the performance of the wells and the recovery factor on production. Thus the early determination of these thermal stress characteristics for each well allows for an optimum injection program.

Injection testing therefore provides two main pieces of information needed for the optimum field development planning:

The value of the large-scale thermal stress parameter for the design of the water injection system.

Large scale flow properties of the reservoir through well test interpretation, which can be used as calibration points for the reservoir model.

The principle advantage of the present invention is that it provides a method for a well injection program in which injection testing is used to determine thermal stress characteristics of the existing well during start-up.

A further advantage of the present invention is that it provides a method for a well injection program in which injection testing is used to determine more accurate values for parameters used in well interpretation.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

I claim:

1. A method for a well injection program, comprising the steps:

(a) injecting a fluid into the well;

(b) varying the flow rate of injected fluid;

(c) measuring the pressure, temperature and flow rate at the well as the flow rate is varied to provide measured data;

(d) fitting a first model to the measured data to estimate one or more thermal stress characteristics of the well;

(e) inputting the one or more thermal stress characteristics into a second model;

(f) determining injection parameters from the second model; and further including the step of measuring pressure for different temperatures of injected fluid.

2. A method for a well injection program, comprising the steps:

(a) injecting a fluid into the well;

(b) varying the flow rate of injected fluid;

(c) measuring the pressure, temperature and flow rate at the well as the flow rate is varied to provide measured data;

(d) fitting a first model to the measured data to estimate one or more thermal stress characteristics of the well;

(e) inputting the one or more thermal stress characteristics into a second model; and (f) determining injection parameters from the second model;

and further including the step of measuring the pressure and flow rate during a first injection cycle and determining fracturing has occurred.

3. The method according to claim 2 wherein the method includes the steps of performing a series of step rate tests and measuring fracture pressure.

4. The method according to claim 2 wherein the method includes the steps of performing injection cycling and fall-off analysis.

5. The method according to claim 2 wherein the method includes the step of stepping-up the flow rate to a maximum value for an injection period.

6. The method according to claim 2 wherein the method includes the step of stepping-down the flow rate from a maximum value for an injection period.

7. The method according to claim 2 wherein the method includes the steps of shutting in the well for fixed periods between increasing an injection periods.

8. The method according to claim 2 wherein the first model describes the development of the thermal stresses around the well on the measured data to estimate a thermal stress characteristic.

9. The method according to claim 2 wherein the one or more thermal stress characteristics is a thermal stress parameter being a minimum in situ stress value.

10. The method according to claim 2 wherein the second model is a reservoir model.

11. The method according to claim 2 wherein the second model is a hydraulic fracture model.

12. The method according to claim 2 wherein the pressure, temperature and flow rate are measured by sensors at a surface of the well.

13. The method according to claim 2 wherein the at least one downhole sensor is used to measure downhole pressure.

14. The method according to claim 2 wherein the measured data is analysed in real-time.

15. The method according to claim 2 wherein the method includes the step of measuring pressure for different temperatures of injected fluid.

16. The method according to claim 2 wherein parameters for the second injection cycle are determined from the first injection cycle.

17. The method according to claim 16 wherein the step is repeated for further injection cycles.

18. The method according to claim 2 wherein the injection parameters are selected from a group comprising: injection fluid temperature, fluid pump rate, fluid pump duration and fluid injection volume.

19. The method according to claim 2 wherein the method includes the further step of carrying out well injection using the injection parameters.

20. The method according to claim 2 wherein the method includes the further step of carrying out the steps on one or more additional wells and the second model combines the thermal stress characteristics from all the wells to determine individual well injection parameters.

* * * * *